US006014936A

United States Patent [19]

Rogers et al.

[11] Patent Number: 6,014,936

[45] Date of Patent: Jan. 18, 2000

[54] VARIABLE HEIGHT FOLD AND ROLL STAGING AND METHOD OF ASSEMBLING SAME

[75] Inventors: Orley David Rogers, Farwell; Kenneth Edward Staten, Clare, both of Mich.

[73] Assignee: Stageright Corporation, Clare, Mich.

[21] Appl. No.: 09/123,178

[22] Filed: Jul. 27, 1998

[51] Int. Cl.[7] ..... A47B 3/00

[52] U.S. Cl. ..... 108/167; 108/117

[58] Field of Search ..... 108/117, 120, 108/119, 170, 167, 177; 52/7, 795

[56] References Cited

U.S. PATENT DOCUMENTS

| | | | |
|---|---|---|---|
| 2,817,389 | 12/1957 | Richards . | |
| 2,958,873 | 11/1960 | Ferneau | 108/117 X |
| 3,091,196 | 5/1963 | Hirsch | 108/170 |
| 3,351,029 | 11/1967 | Bue | 108/170 |
| 3,545,738 | 12/1970 | Stagg | 108/167 X |
| 4,006,564 | 2/1977 | Wiese . | |
| 4,779,542 | 10/1988 | Staten et al. . | |
| 4,993,706 | 2/1991 | Wilkinson | 108/117 X |
| 5,325,794 | 7/1994 | Hontani | 108/117 |
| 5,349,789 | 9/1994 | Andert et al. . | |

FOREIGN PATENT DOCUMENTS

| | | |
|---|---|---|
| 2918646 | 11/1980 | Germany . |
| 4120711 | 4/1992 | Germany . |

*Primary Examiner*—Jose V. Chen
*Attorney, Agent, or Firm*—Mayer, Brown & Platt

[57] ABSTRACT

A variable height staging for forming a staging surface for presentations or performances by orators, singers, dancers, actors and others who may appear on a stage. The staging of the invention can be assembled to form staging surfaces of variable height. The variable staging can be assembled to form staging surfaces of more than three different heights. The variable staging includes at least one platform panel and a cross brace member having at least one caster attached thereto. A slot and groove assembly comprised of at least one plate, a slot or track and at least one groove for engaging a cross pin is pivotally attached to the cross brace member. The variable staging further includes at least two cross legs; one of the cross legs has a support end and a pivot end attached to the bottom surface of the platform panel and the other cross leg has a support end and a locking end that is engaged by the slot and groove assembly. The cross legs are attached to each other at a center point. The cross legs may be further connected together by a telescoping arm connected between them. The relationship between the cross legs about their center point determines the height of the variable staging. The disclosure is further directed to a method of assembling the variable staging.

21 Claims, 8 Drawing Sheets

VARIABLE HEIGHT FOLD AND ROLL STAGING AND METHOD OF ASSEMBLING SAME

BACKGROUND OF THE INVENTION

1. Field of the Invention

The present invention relates to portable equipment for forming a stage platform of variable height. The stage platform of the present invention is stable at each of the heights to which it can be adjusted. Particularly, the present invention is directed to variable height staging including a platform panel pivotally attached to a cross brace member by a slot and groove assembly. Engaged within and extending from the slot and groove assembly is a cross leg that, in combination with a second cross leg, provides the support for the platform panels that form the staging. The two cross legs are fastened to each other by a center joint located approximately midway along the length of each cross leg. Relative movement about the center joint of the cross legs adjusts the height of the variable height staging of the invention. By locking the end of the cross leg within a groove of the slot and groove assembly, the resulting height of the staging can be secured. A telescoping arm having a securing pin also is provided between the cross legs to further secure the resulting height of the staging. The present invention further includes a method of assembling the variable height staging.

2. Description of Related Art

A frequent component of the activities of civic, educational, religious, and charitable and corporate organizations is, for example, musical or dramatic performances to an audience. The audience's ability to view and enjoy such performances is greatly enhanced when the performers are elevated on a stage above ground level. Preferably, if the performance includes many individuals, it is desirable to have multiple levels of staging above ground level to optimize the audience's ability to view all of the performers. For the safety of the performers and the audience, the staging should be stable for every height at which it is used.

Despite the frequent need for staging in their activities, many organizations do not have access to facilities with permanent stage platforms. Consequently, when staging is needed, the organization must rent or otherwise procure the equipment, assemble the equipment, and, after the performance, dismantle the equipment. Because of the temporary nature of the staging used by some organizations, it is desirable to have staging that is, among other desirable properties, easy to set-up, stable during use, easy to store, and easy to transport. It is also desirable to have staging that is adjustable to more than one height, thereby eliminating the need for having multiple units each capable only of forming a single stage height.

Some stagings currently available do not provide adequate stability when assembled to provide an elevation higher than the initial fixed elevation. For example, telescoping portions of legs and supports have been used in isolation to adjust the height of staging platforms. The telescoping portion of the leg or support is extended, typically to a preset distance, and then is secured by inserting a pin into a hole located at a preset point along the leg or support. The telescoping portion for each leg or support of the staging is extended to the same preset distance, so that each leg or support is at the same height after increasing the elevation of the staging. If not adequately braced, however, the more a telescoping portion is extended, the more unstable the staging platform will become. To a certain extent, this may due to the telescoping portion being substantially hollow and smaller in diameter than the non-telescoping portion of the leg or support. The telescoping portion generally is substantially hollow to reduce weight and accommodate holes being formed at predetermined distances for insertion of the pins. The instability of such staging is evidenced by wobbling that occurs as performers move onto and off of the platform of the staging.

Another disadvantage of telescoping leg portion mechanisms for increasing the height of the staging is that each leg or support must be individually adjusted. This creates the possibility that the legs or supports may not be evenly adjusted. Uneven adjustment results in an uneven and unsteady platform surface.

Additionally, the staging currently available often is limited to only two or three different height adjustments. This is a disadvantage when the performing group has many members or requires more than three heights of stage for the choreography of the performance. Particularly, staging having telescoping leg portions is frequently limited to three different heights; the limiting factor being the number of preset holes that can be formed in the telescoping portion of the legs for pin insertion.

In view of the above, there remains a need for staging that is easy to transport and store, is simple to assemble, has improved stability when assembled, and is adjustable to a variety of heights. A need also exists for a mechanism for increasing the platform height of temporary staging that reduces wobbling and that increases the number of heights at which the staging could be assembled. Greater flexibility in height thus increases the number and variety of performances that can be executed using the temporary staging.

SUMMARY OF THE INVENTION

The purpose and advantages of the invention will be set forth in and apparent from the description and drawings that follow, as well as will be learned by practice of the invention. In addition to the description that follows, the entire disclosure and drawings of U.S. Pat. No. 4,779,542 are incorporated by reference herewith.

The novel variable height staging of the present invention includes at least one platform panel and a cross brace member having at least one caster attached thereto. The cross brace member is generally U-shaped and has upright distal ends. Pivotally attached to each of the upright distal ends of the cross brace member is a slot and groove assembly comprised of two plates, which, in turn, is secured to a corresponding platform panel. Each plate has a slot or track and at least one groove for engaging a cross pin. The two plates form a channel therebetween. Fixed to the center of the cross brace member is an upright member. Pivotally connected to the base of the upright member are two or more struts. The opposite ends of the struts are attached to the bottom surfaces of the platform panel elements. The cross brace member, upright member, and struts define a hinged frame system that permits the panel elements to be connected in both the folded and assembled positions.

In accordance with the invention, each side of the platform panel elements is associated with two cross legs. Each of the cross legs has a support end that supports the weight of the staging when the variable height staging is assembled. One of the cross legs has a locking end, opposite the support end, that is engaged within the channel of the slot and groove assembly. The locking end has a cross pin that extends between the plates of the slot and groove assembly. Each of the ends of the cross pin is received by the slot of one of the plates of the slot and groove assembly. The ends of the cross pin move along the slot of the plate until engaged by a groove that will result in the desired final height of the variable height staging.

The second cross leg has a pivot end opposite its support end. The pivot end is attached to the panel element at the end opposite the slot and groove assembly. The two cross legs are fastened to each other by a center joint located approximately midway along the length of each cross leg. The center joint permits the support ends of the cross legs to move toward and away from each other. Motion about the center joint of the cross legs determines the height of the variable height staging of the invention.

A telescoping arm is positioned between the support end of the cross leg having the locking end and between the support end and the center joint of the cross leg having the pivot end. The telescoping arm extends and contracts when the cross legs are moved about the center joint. The telescoping arm has a series of pin holes. When a securing pin is inserted into one of the pin holes of the telescoping arm, the telescoping arm is locked at a fixed length and, therefore, the support ends of the cross legs are locked at a fixed distance apart from each other.

In addition to the length of the telescoping arm changing as the cross legs move in relation to each other about the center joint, simultaneously the cross pin of the locking end moves along the slot of the slot and groove assembly. When the desired height of the variable height staging is reached by positioning the support ends of the cross legs the desired distance apart, the cross pin is engaged by one of the grooves along the slot so that the locking end is in a fixed position.

The variable height staging of the invention is in a folded position for purposes of storing and transporting the staging, such that the platform panel elements are upright and substantially parallel to each other. The cross legs are collapsed or folded up against the back surfaces of the panel elements. For easy transporting, the casters attached to the cross brace member are in contact with the floor when the variable height staging is in the folded position so as to support the weight of the structure. When the variable height staging is in the assembled position, the panel elements form a parallel surface with the floor and the casters are no longer touching the floor.

The method of assembling the variable height staging of the invention comprises the steps of rolling, or otherwise positioning, the folded staging on its casters into the desired position, removing the securing pins from the pin holes of the telescoping arms, pulling the support ends of the cross legs out and away from the panel elements until the position for the desired height is reached, checking to ensure that the cross pin of a cross leg is engaged by one of the grooves of the slot and groove assembly, and replacing the securing pin in the appropriate pin hole of the telescoping arm. The support ends of both sets of cross legs are pulled downward until each of the support ends of the cross legs are in contact with the floor or support plane. When the support ends are in contact with the floor or other surface, the resulting position of the panel elements forms a continuous staging surface capable of supporting the weight of one or more performers.

One or more variable height staging devices of the invention can be assembled to form a staging surface of variable height. For example, for purposes of staging a singing ensemble, a grouping of variable height stagings may be assembled to form a staging surface of gradually increasing heights. Other formations of variable height stagings can be assembled to create customized staging surfaces.

It is to be understood that both the foregoing general description and the following detailed description are exemplary and provided for purposes of explanation only, and are not restrictive of the invention, as claimed.

BRIEF DESCRIPTION OF THE DRAWINGS

The accompanying drawings, which are incorporated in and constitute a part of this specification, illustrate a preferred embodiment of the invention, and together with the description, serve to explain the principles of the invention.

DETAILED DESCRIPTION OF THE PREFERRED EMBODIMENT

Figure 1A:
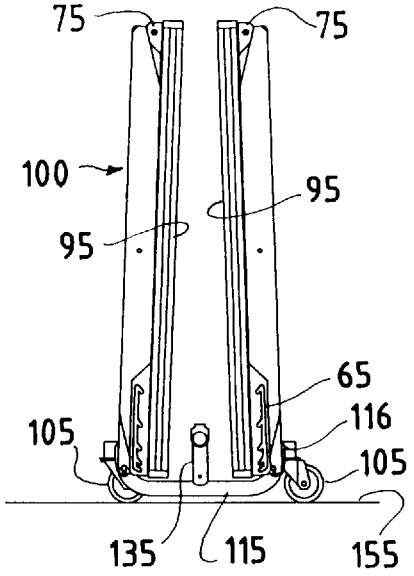
FIG. 1 is a series of schematic side views (FIGS. 1*a* through 1*e*) of the variable height staging of the present invention and of the steps comprising the method of assembling the variable height staging.

Reference will now be made in detail to the present preferred embodiment of the variable height staging of the invention, examples of which are illustrated in the accompanying drawings. Wherever possible, the same reference characters will be used throughout the drawings to refer to the same or like parts. The method of the present invention will be described in conjunction with the detailed description of the variable height staging for clarity.

An exemplary embodiment of the variable height staging of the present invention is shown in FIG. 1 and designated generally by reference character 100. FIGS. 1*a* through 1*e*, collectively referred to as FIG. 1, show side views of the variable height staging 100 of the invention in both the folded and assembled positions. Particularly, FIG. 1 shows views in FIGS. 1*a* through 1*e* depicting the variable height staging 100 of the invention in the various stages of assembly. FIG. 1*a* shows the variable height staging 100 in the folded position prior to assembly; FIG. 1*e* shows the variable height staging 100 in the assembled position. It should be understood that a similar structure is provided on each side of the staging. That is, and as evident in FIGS. 3*b*, 4*b*, 5*b* and 6*b*, the back side (not visible in FIG. 1) is substantially the same as the front side. For brevity, only one side of the staging will be described in detail unless otherwise noted or evident from the drawings.

Figure 7:
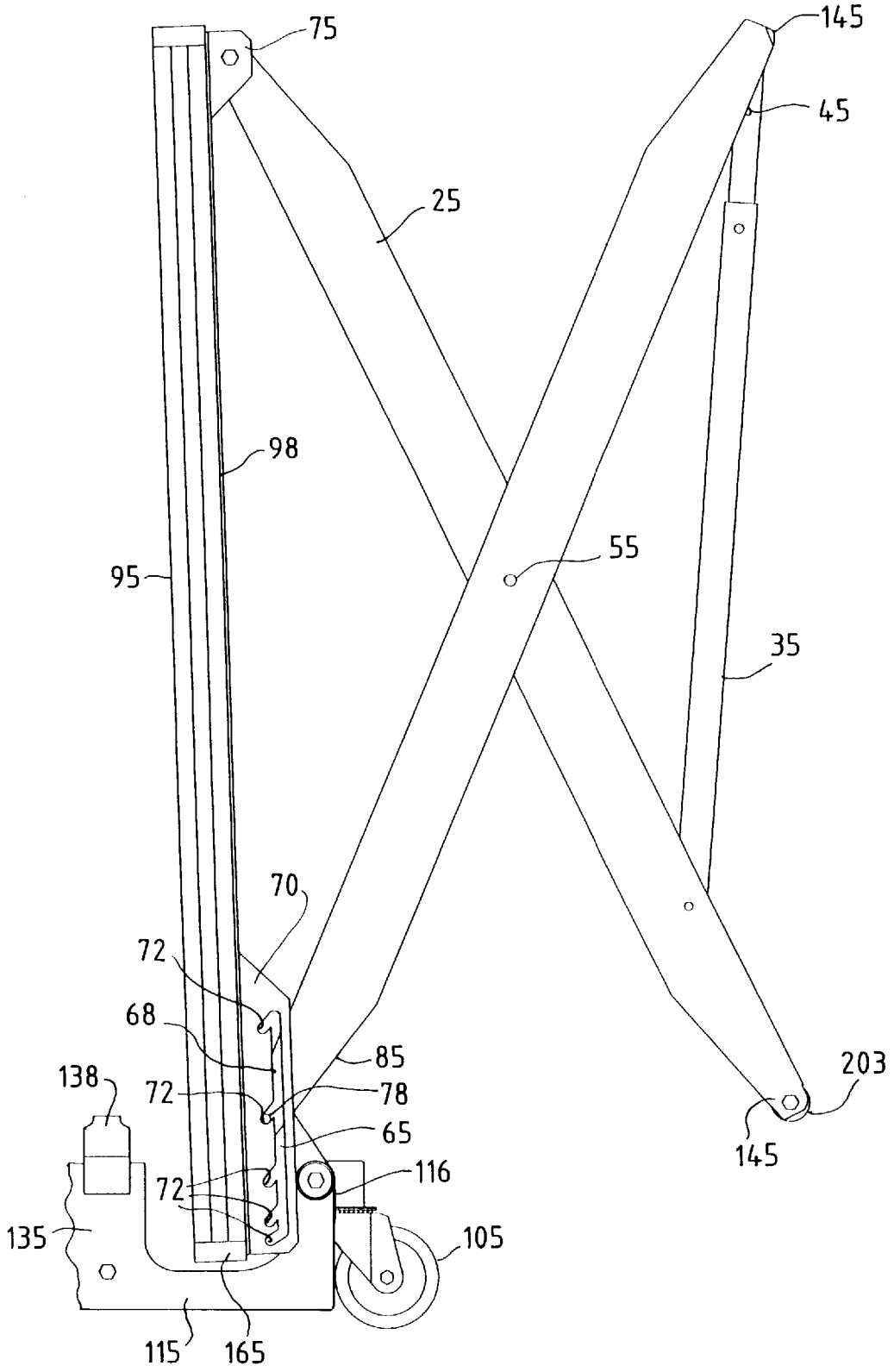
FIG. 7 is an enlarged view of an alternative embodiment of one half of the variable height staging shown in FIG. 1.

The variable height staging 100 of the invention comprises a cross brace member 115 with at least one caster 105 attached thereto; preferably, casters are provided at each of the opposing ends of the cross brace member 115. FIG. 1 a shows that the cross brace member 115 is closest to the floor or support plane 155 when the variable height staging 100 is in the folded position. As further shown in FIG. 1, the cross brace member 115 embodied herein is a generally "U" shaped structure having upright distal ends 116. Another embodiment of the cross brace member 115, also having a generally "U" shaped structure, is shown in FIG. 7.

Figure 1B:
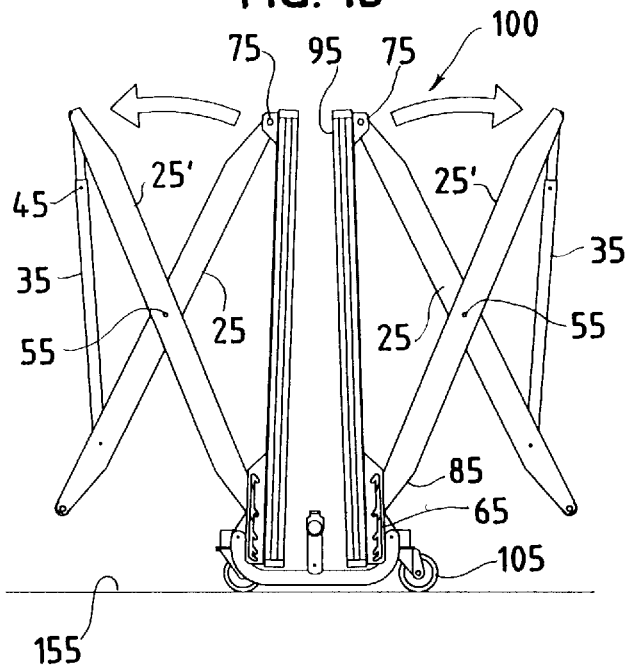
Figure 2:
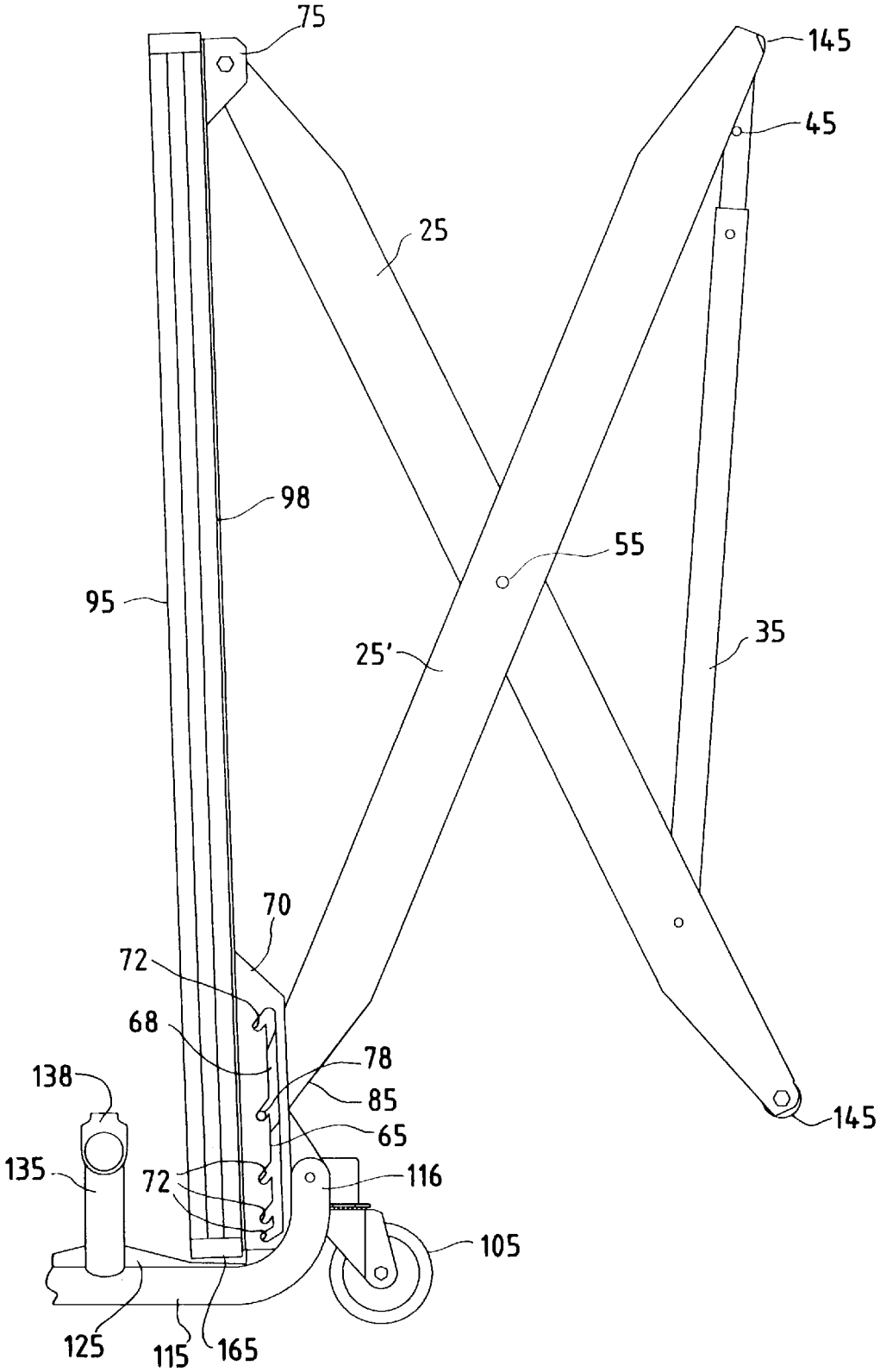
FIG. 2 is an enlarged view of one half of the variable height staging shown in FIG. 1.

Pivotally attached to each of the upright distal ends 116 of the cross brace member 115 is a slot and groove assembly 65. FIGS. 2 and 7 depict an enlarged view of one half of the variable height staging 100 shown in FIG. 1*b*. FIGS. 2 and 7 also show enlarged views of the slot and groove assembly 65 of the invention. Each slot and groove assembly 65 embodied herein generally comprises two plates 70, although one plate 70 may be used if desired to reduce costs, forming a channel therebetween. For example, only one of two plates 70 is visible in FIGS. 2 and 7; the second plate 70 is spaced from the visible plate 70. Each plate 70 of the assembly 65 has a slot 68 and one or more grooves defined therein 72. The slot 68 is a track permitting movement between and connecting the grooves 72. The relative positions of the grooves 72 along the slot 68 are related to the final height to which the variable height staging 100 can be assembled.

At the center point of the length of the cross brace member 115 embodied herein is an upright member 135 having an end cap 138. Pivotally connected to the base of the upright member 135 are two or more struts 125. As depicted in FIG. 1*d*, at least one strut 125 is connected at each side of the base of the upright member 135; the opposite end of each strut 125 is connected to the bottom surface 98 of a platform panel element 95. Additionally, and as embodied herein, the plates 70 of a corresponding slot and groove assembly 65 are also secured to the bottom surface 98 of the panel element 95. The panel element 95 therefore is pivotally attached to the upright distal ends 116 of the cross brace member 115. The platform panel element 95 is the component of the variable height staging 100 that forms the staging surface on which performers are supported, when the variable height staging 100 is assembled.

In combination, the upright member 135, the struts 125, and the cross brace member 115 compose a hinged frame system that permits more two or more panel elements 95 to be connected together. The combination of the upright member 135 and struts 125 permit the inner edges of the connected panel elements 95 to rotate past each other without colliding. Additionally, end cap 138 of the upright member 135 is configured to prevent the edges of the panel elements 95 from rotating past the end cap 138. When the variable height staging 100 is fully assembled, the combination of the upright member 135 and struts 125 provide support to the center of the staging 100.

In accordance with the invention, each side of the panel element 95 is associated with two or more cross legs 25. While there may be more than two cross legs 25 associated with each panel element 95, at least one set of two cross legs 25 is provided on each side of the panels embodied herein. Each cross leg 25 has a support end 145 to be positioned against the support plane 155 or floor when the variable height staging 100 is fully assembled. As shown in FIG. 7, the support end 145 of cross leg 25 can have a roller 203. The roller 203 facilitates folding the staging to a storage position. Each set of two cross legs includes one cross leg 25 having a pivot end 75 pivotally connected to the panel 95 and another cross leg 25' having a locking end 85 engaged by a corresponding slot-and-groove assembly as best shown in FIG. 2. The two cross legs 25 are connected together at a center joint 55. The pivot end 75 of one cross leg 25 is attached to the panel element 95 at the end opposite where the slot and groove assembly 65 is secured. The locking end 85 of the other cross leg 25' is positioned in the channel formed by the plates 70 of the slot and groove assembly 65.

The locking end 85 of the cross leg 25' has a cross pin 78 that extends between the plates 70 of the slot and groove assembly 65 of the locking end 85. Particularly, the ends of the cross pin 78 are received by the slots 68 of the two plates 70 of the slot and groove assembly 65. The ends of the cross pin 78 can move freely along the slot 68 between the grooves 72. As such, the ends of the cross pin 78 travel along the slot 68 as the locking end 85 is moved along the channel formed between the plates 70 of the slot and groove assembly 65. When a fixed position of the locking end 85 is desired, the ends of the cross pin 78 are slid into corresponding grooves 72 of the plates 70. When the ends of the cross pin 78 are received by such grooves 72, the locking end 85 of the cross leg 25 is stable and immobilized. Preferably, the grooves 72 are angled relative to the slot 68 as shown in FIG. 2. In this manner, and with the platform panel 95 in an upright position, the cross pin 78 will drop into a proximate groove 72 due to gravity.

Figure 8:
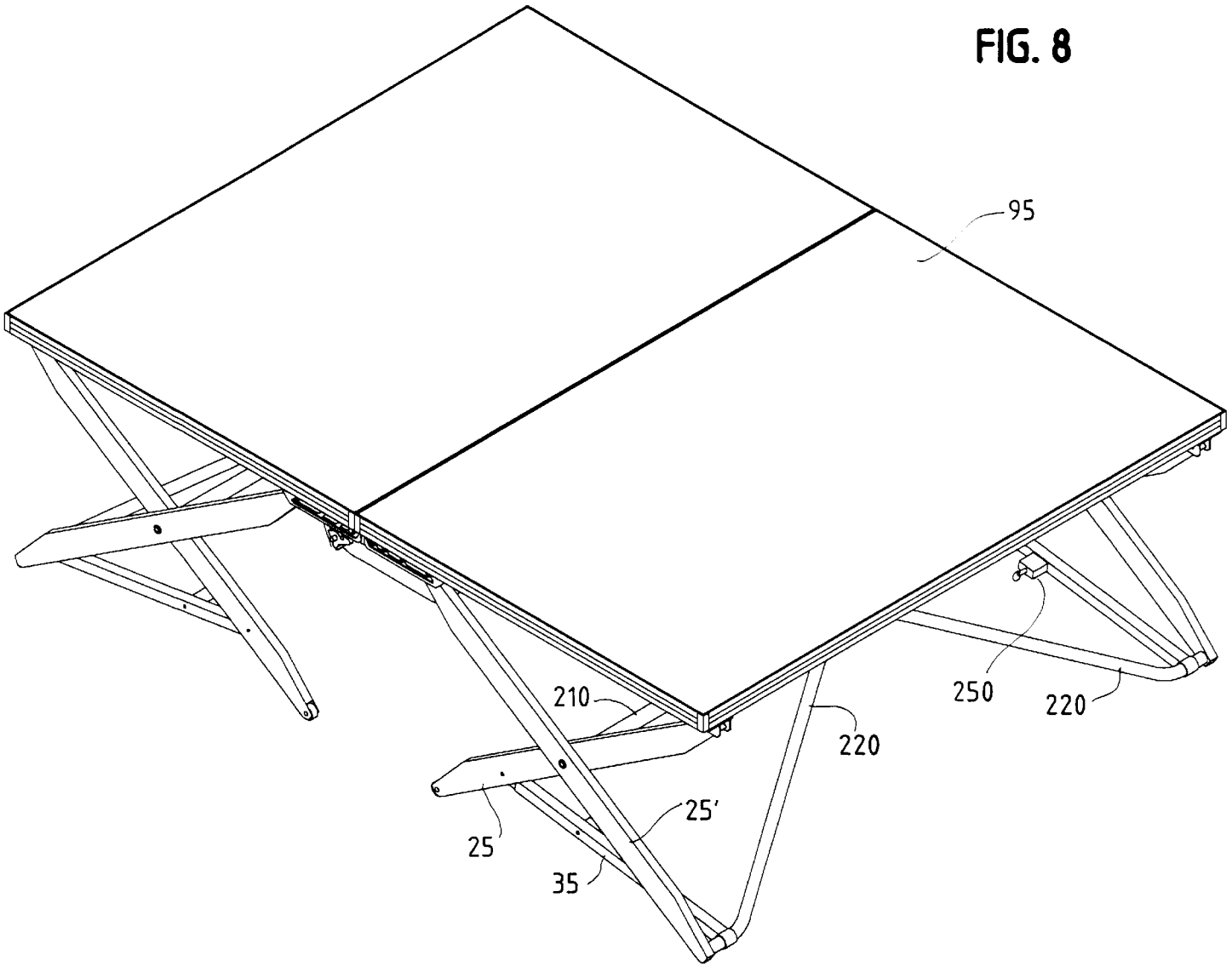
FIG. 8 is a perspective view of an embodiment of the variable height staging of the present invention in an assembled position.
Figure 9:
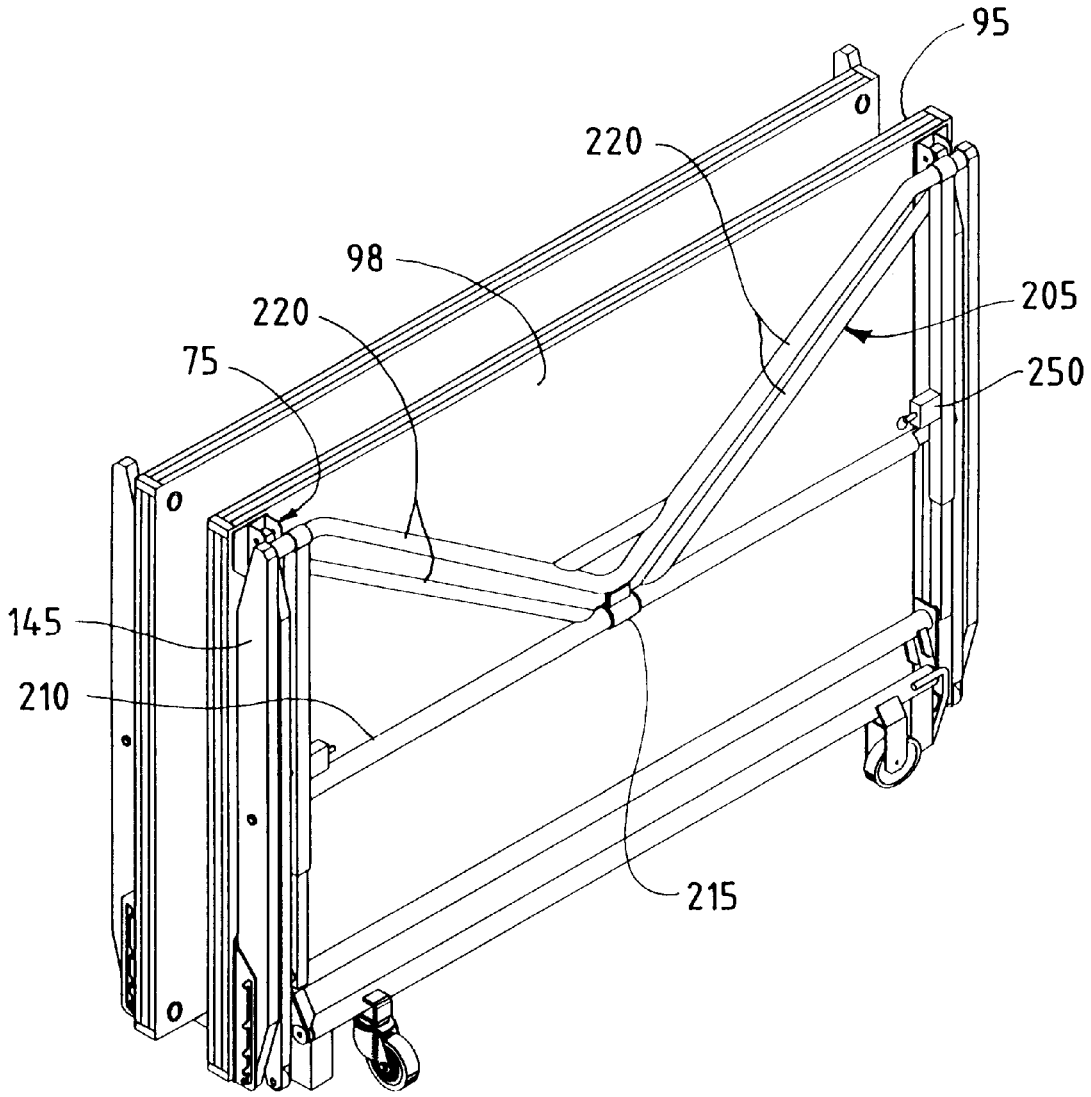
FIG. 9 is a perspective view of an embodiment of the variable height staging of the present invention in a storage position.

The connection between the locking end 85 and the slot and groove assembly 65 thereby secures the relative position of the two cross legs 25 connected at a center joint 55. Additional stability is provided by a telescoping arm 35 extending between the two cross legs 25, as shown in the drawings. One end of the telescoping arm 35 is attached to the support end 145 of the cross leg 25' having the locking end 85. The other end of the telescoping arm 35 is attached to between the center joint 55 and the support end 145 of the cross leg 25 having the pivot end 75. The telescoping arm 35 has a series of pin holes 45 along its telescoping end. When a pin is inserted through one of the pin holes 45, the length of the telescoping arm 35 is thus fixed. As a result, when a pin is inserted in one of the pin holes 45 of the telescoping arm 35, the support ends 145 of the cross legs 25 are a fixed distance apart. As shown in FIGS. 8 and 9, the telescoping arm 35 can include a locking mechanism 250 for positioning of the pin within one of the pin holes 45. In a preferred embodiment, the locking mechanism 250 includes a spring-loaded pin.

In a preferred embodiment, the variable height staging 100 includes a brace 205 as shown in FIGS. 8 and 9. The brace 205 has a center stabilizing rod 210. The ends of the center stabilizing rod 210 are each connected to a pair of cross legs 25. For example, an end of the center stabilizing rod 210 can be connected at the center point 55 of the pair of cross legs 25. The center stabilizing rod 210 is pivotally connected at its midpoint to four radiating rods 220. Each of the radiating rods 220 is connected to a rotating joint 215 on the center stabilizing rod 210. Two of the radiating rods 220 terminate at the support ends 145 of opposing cross legs 25' having locking ends 85. The other two radiating rods 220 terminate at the pivot ends 75 of opposing cross legs 25. The brace 205 increases the strength and stability of the variable height staging 100.

With the structure of the variable height staging 100 understood, the method of assembling the variable height staging 100 will now be described. The steps of the method of assembling the variable height staging are depicted in FIGS. 1*a* through 1*e*. Prior to assembly, the variable height staging 100 is in a folded position as depicted in FIG. 1*a*. When in the folded position, the casters 105 attached to the cross brace member 115 contact the support plane 155 or floor so as to support the weight of the folded staging. The casters 105 permit easy transportation of the variable height staging 100 from its storage location to the desired assembly location. In the folded position, the panel elements 95 are in a vertical, upright position in relation to the cross brace member 115. The cross legs 25 are collapsed or folded up against the bottom surfaces 98 of the panel elements 95. A first step of the method of the invention therefore is to position the variable height staging 100 in the location where a stage surface is needed or desired.

A second step of the method is to remove the pins from the pin holes 45 of the telescoping arms 35. Once the pin is removed from a pin hole 45, the telescoping arm 35 is unlocked so as to allow its length to be changed. The support end 145 of the cross leg 25 connected to the released telescoping arm is then pulled downward and outward away from the bottom surface 98 of the panel element 95 as depicted in FIG. 1*b*. The degree to which the support end 145 is pulled will depend on the desired final height of the variable height staging 100. The more the support end 145 is pulled out, the higher the final height of the variable height staging 100. As the support end 145 is pulled out, the cross leg 25' likewise will move relative to cross leg 25 about the center joint 55. Particularly, the support ends 145 of the cross legs 25, 25' will move closer together, thus decreasing the length of the telescoping arm 35, as the support end 145 of the cross leg 25 is pulled out.

Another consequence of pulling the support end 145 of each cross leg 25 away from the bottom surface 98 of the panel element 95 is movement of the cross pin 78 of the locking end 85 of the corresponding cross leg 25' along the slot 68 of the slot and groove assembly 65. The movement of the cross pin 78 will be limited to the dimensions of the slot 68. This constraint likewise limits movement of the locking end 85 of the cross leg 25' to the channel created between the plates 70 of the slot and groove assembly 65. The height to which the variable height staging 100 is adjustable will be proportionate to the relative positions of the cross legs 25. Each of the grooves 72 along the slot 68 of the slot and groove assembly 65 represents a different relative position for the cross legs 25 and, therefore, a different final height of the variable height staging 100. Because there can be any number of grooves 72 along the slot 68 of the plates 70, the variable height staging 100 likewise can be assembled to a variety of different final heights.

After the support ends 145 of the cross legs 25 are pulled out the required distance to result in the desired final height, the pin is replaced in the pin hole 45 of the telescoping arm 35. At that distance, the ends of the cross pin 78 of the locking end 85 of the cross leg 25' should be engaged by opposed grooves 72 of the slot and groove assembly 65 that likewise correspond to the desired final height. The relative position of the cross legs 25 therefore is fixed and secured in two ways: replacing the pin to restrict further movement of the telescoping arm 35 and engaging the ends of the cross pin 78 of the locking end 85 of the cross leg 25' into corresponding slots 72 of the slot and groove assembly 65. This process is performed simultaneously on both sides of a platform panel for uniformity, and then repeated for each remaining platform panel.

Figure 1C:
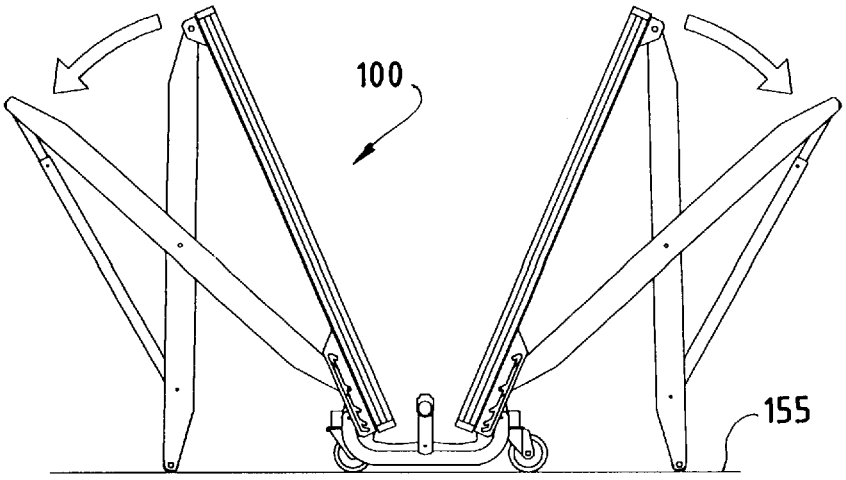
Figure 1D:
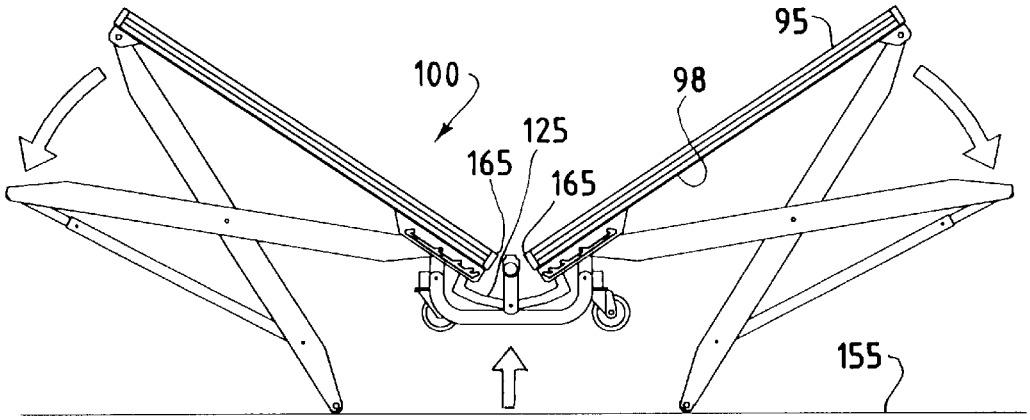

A next step of the method is depicted by FIG. 1*c*. The support ends 145 of the fixed positioned cross legs 25 are drawn toward the support plane 155 or floor. The support end 145 of the cross leg 25 having the pivot end 75 is the first to engage the support plane 155. Preferably, this step is repeated for each platform panel 95 so as to create a V-shaped configuration as shown in FIG. 1*c*. As the support ends 145 of the cross legs 25' are further drawn toward the support plane 155, the hinged frame system comprising, in part, the cross brace member 115 is lifted off the support plane 155 as shown in FIG. 1*d*. During this step of the method, the edges 165 of the panel elements 95 connected to the struts 125 move toward each other. The combination of the upright member 135 and struts 125 permit the edges 165 of the panel elements 95 to clear each other as they are rotated upward away from the support plane 155. The end cap 138 of the upright member 135 prevents the edges 165 from rotating past the top of the upright member 135.

Figure 1E:
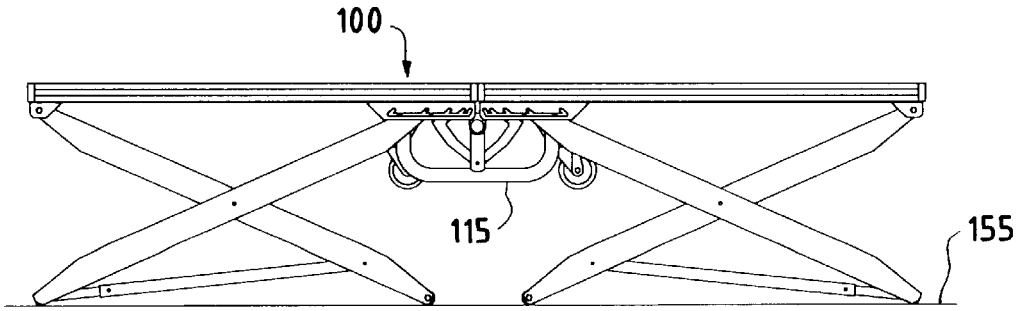

In the fully assembled position depicted in FIG. 1*e*, all of the support ends 145 of the cross legs 25, 25' engage the support plane 155 to support the panel elements 95. The panel elements 95 are aligned to form a stable, horizontal staging surface capable of supporting the weight of multiple performers. The hinged frame system comprising the cross brace member 115, struts 125, and upright member 135 likewise provide support to the center of the variable height staging 100.

Figure 3A:
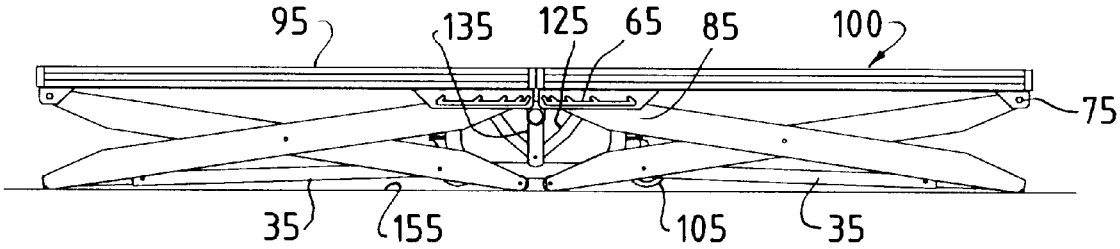
FIGS. 3*a*, 3*b* collectively includes side and end views of the variable height staging of the invention assembled at its base, or lowest, height.
Figure 3B:
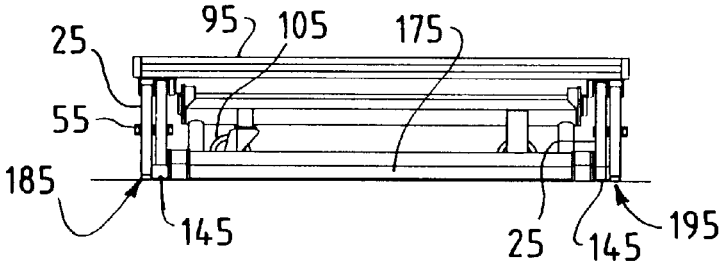

FIGS. 3 through 6 show variable height stagings 100 of the invention assembled by the method of the invention to form staging surfaces of increasing height. FIG. 3 shows a side view, FIG. 3*a*, and an end view, FIG. 3*b*, of a variable height staging 100 embodied herein at its lowest height position. When assembled at the lowest height, the casters 105 of the variable height staging 100 may still touch the support plane 155 such as a floor if desired. The cross pins 78 of the locking ends 85 are engaged in the grooves 72 of the slot and groove assemblies 65 located closest to the upright member 135 of the hinged frame system.

As can be seen in the end view FIG. 3*b*, the variable height staging 100 of the invention can have a hinged frame system and pair of casters 105 at the front side 185 and at the back side 195 of the panel elements 95. In order to support the staging surface at both ends of the widths of the two panel elements 95, four sets of cross legs 25 are provided. Also visible in FIG. 3*b* is a pair of lateral bars 175 connecting support ends 145 of the front end 185 to the support ends 145 of the back end 195 of the variable height staging 100. Assembly of the variable height staging 100 of FIG. 3 would require removal and replacement of a pin for each of the four telescoping arms 35. There are also four slot and groove assemblies 65 that are present in the variable height staging shown in FIG. 3. The four sets of telescoping arms 35 and slot and groove assemblies 65 provide substantial stability to the staging surface formed by the panel elements 95.

Figure 4A:
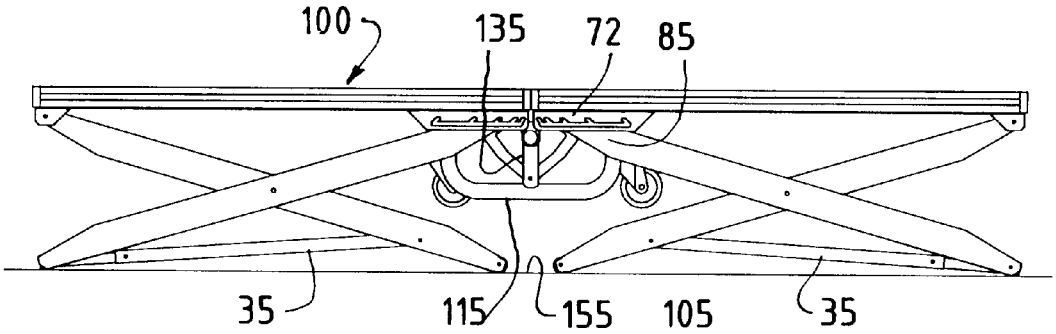
FIGS. 4*a*, 4*b* collectively includes side and end views of the variable height staging of the invention assembled at a first intermediate height.
Figure 4B:
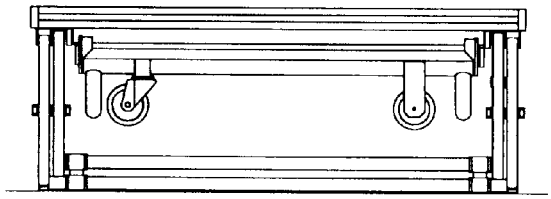
Figure 5A:
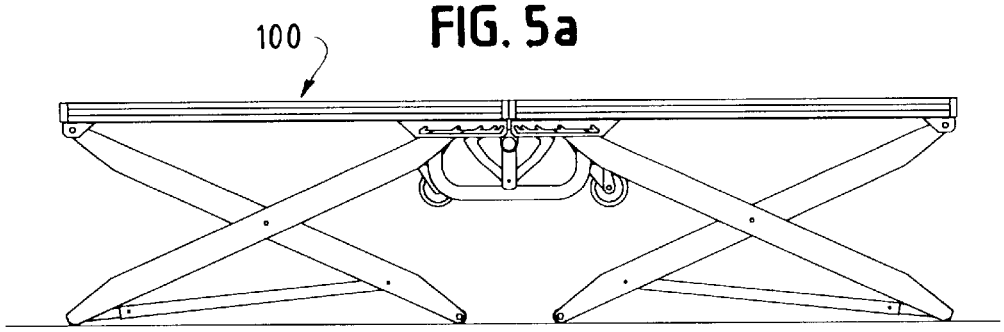
FIGS. 5*a*, 5*b* collectively includes side and end views of the variable height staging of the invention assembled at a second intermediate height.
Figure 5B:
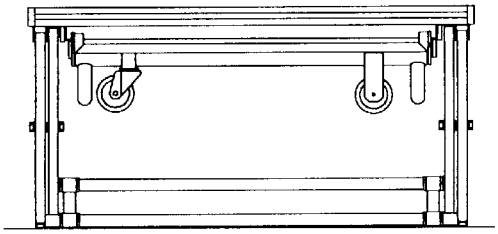

FIG. 4 shows a side view, FIG. 4*a*, and an end view, FIG. 4*b*, of the variable height staging 100 of the invention assembled at an intermediate height, higher than the height of the staging 100 shown in FIG. 3. The casters 105 attached to the cross brace member 115 are not touching the support plane 155. The cross pins 78 of the locking ends 85 are in different grooves 72, further away from the upright member 135, than in FIG. 3. Additionally, the lengths of the telescoping arms 35 in FIG. 4 are shorter than the lengths of the telescoping arms in FIG. 3. FIG. 5 shows a side view, FIG. 5*a*, and an end view, FIG. 5*b*, of the variable height staging 100 of the invention assembled at a second intermediate height, higher than the height of the staging 100 in FIG. 4.

Figure 6A:
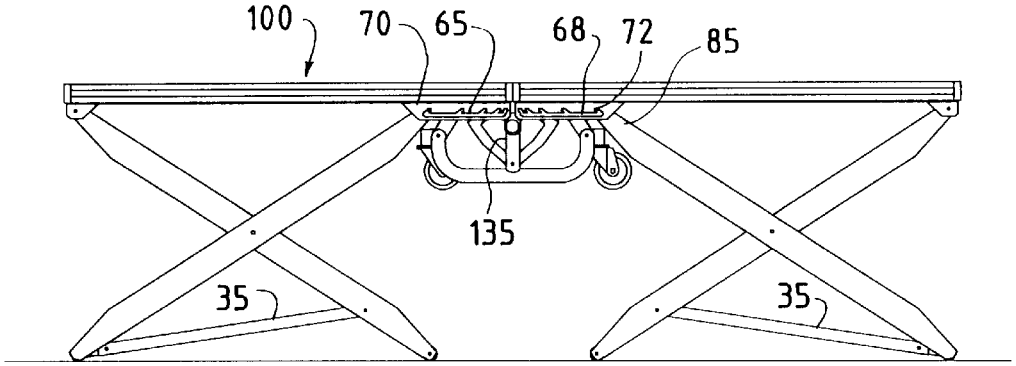
FIGS. 6*a*, 6*b* collectively includes side and end views of the variable height staging of the invention assembled at its maximum height.
Figure 6B:
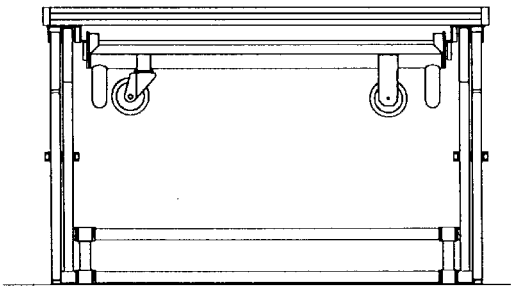

FIG. 6 shows a side view, FIG. 6*a*, and an end view, FIG. 6*b*, of the variable height staging 100 of the invention assembled at the highest height available. The cross pins 78 of the locking ends 85 are engaged in the grooves 72 at the ends of the slots 68 furthest away from the upright member 135. The telescoping arms 35 are fully contracted to their shortest lengths. Though the cross pins 78 are engaged in the grooves 72 at the ends of the slots, the locking ends 85 remain fixed between the channels created by the plates 70 of the slot and groove assemblies 65.

In view of the description above, it is evident that the present invention is an improvement over currently available portable staging devices that vary in height. The variable height staging of the invention can be assembled to provide multiple staging surface heights. At each of the heights to which the variable height staging can be assembled, the panel elements forming the staging surface are stable and resistant to wobbling.

Although reference has been made to the use of the present invention to provide alternative heights for a stable staging surface, for the purpose of explanation, it is understood that alternative benefits can be achieved through use of the variable height staging to form a temporary stage for musical and dramatic performances. Additionally it should be understood that any of a variety of suitable materials of construction and dimensions may be used to satisfy the particular needs and requirements of the end user. It also will be apparent to those skilled in the art that various modifications and variations can be made in the design and construction of the variable height staging, as well as in the performance of the method of assembling the variable height staging, without departing from the scope or spirit of the invention. Other embodiments of the invention will be apparent to those skilled in the art from consideration of the specification and practice of the invention disclosed herein.

What is claimed is:

1. A variable height staging comprising:

a cross brace member with at least one caster attached thereto;

a slot and groove assembly pivotally attached to the cross brace member, the slot and groove assembly having a plate, the plate comprising a slot with at least one groove defined therein;

at least one platform panel element having a bottom surface, the slot and groove assembly plate connected to the bottom surface of the platform panel element; and at least two pair of cross legs, each pair having a first cross leg having a support end and a pivot end, the pivot end pivotally connected to the bottom surface of the platform panel element and the second cross leg having a support end and a locking end, the locking end having a cross pin, the cross pin engaged by the slot and groove assembly; the first and second cross legs pivotally connected together.

2. The variable staging of claim 1 wherein the cross brace member is generally U-shaped and has upright distal ends.

3. The variable staging of claim 2 wherein the slot and groove assembly is pivotally attached to the cross brace member at one of the upright distal ends.

4. The variable staging of claim 1 wherein the first and second cross legs are pivotally connected at the mid-points of their lengths to form a center joint.

5. The variable staging of claim 1 wherein the cross brace member further comprises an upright member and an end cap, the upright member having a base.

6. The variable staging of claim 5 further comprising a strut having two ends, one end of the strut pivotally connected to the base of the upright member and the other end of the strut connected to the bottom surface of the platform panel element.

7. The variable staging of claim 1 further comprising a telescoping arm having two ends, each end of the telescoping arm is connected proximate the support end of one of the cross legs.

8. The variable staging of claim 7 wherein the length of the telescoping arm is adjustable.

9. The variable staging of claim 1 wherein the slot and groove assembly has at least four grooves to provide at least four different staging assembly heights.

10. A variable height staging comprising:

a cross brace member having an upright member, the upright member having a base, at the center point of the length of the cross brace member, the cross brace member being generally U-shaped and having two upright distal ends; casters attached at opposing ends of the cross brace member;

at least two platform panel elements, each platform panel element having a bottom surface;

at least two struts, each strut having two ends, one end of each strut being connected to the base of the upright member and the other end of each strut being connected to the bottom surface of one of the platform panel elements;

a slot and groove assembly pivotally connected to each of the upright distal ends of the cross brace member, each slot and groove assembly having a plate, the plate having a slot with at least one groove defined therein;

at least two pairs of cross legs associated with each of the platform panel elements, each pair of cross legs comprising a first cross leg having a support end and a pivot end, the pivot end pivotally connected to the bottom surface of one of the platform panel elements and a second cross leg having a support end and a locking end, the locking end having a cross pin, the cross pin being engaged by the slot and groove assembly; the first cross leg and the second cross leg being pivotally connected together at a center joint.

11. The variable staging of claim 10 wherein the slot and groove assembly further comprises two parallel plates forming a channel therebetween, each of the plates having a slot with at least one groove defined therein.

12. The variable staging of claim 11 wherein the locking end of each second cross leg is engaged within the channel formed by the plates of the slot and groove assembly.

13. The variable staging of claim 12 wherein the locking end of each second cross leg has a cross pin with two ends, the ends of the cross pin engaging the slots of the plates of the slot and groove assembly.

14. The variable staging of claim 10 further comprising a brace, the brace further comprising a center stabilizing rod having two ends, each end of the center stabilizing rod connected to a pair of cross legs, the center stabilizing rod pivotally connected at its midpoint to four radiating rods, each of the radiating rods connected to a rotating joint on the center stabilizing rod, two of the radiating rods terminating at the support ends of opposing cross legs having locking ends and the other of the two radiating rods terminating at the pivot ends of opposing cross legs.

15. The variable staging of claim 10 wherein the cross legs having pivot ends further comprise rollers at their support ends.

16. The variable staging of claim 10 further comprising a telescoping arm for each pair of cross legs, the telescoping arm having two ends, one end of the telescoping arm being attached to the support end of the cross leg having the locking end and the other end of the telescoping arm being attached between the center joint and the support end of the cross leg having the pivot end.

17. A method of assembling a variable height staging on a support plane comprising the steps of:

positioning a variable height staging in a desired location, the variable height staging comprising a cross brace member with at least one caster attached thereto; a slot and groove assembly pivotally attached to the cross brace member, the slot and groove assembly having a plate, the plate comprising a slot with at least one groove defined therein; at least one platform panel element having a bottom surface, the plate of the slot and groove assembly being secured to the bottom surface of the platform panel element; the platform panel element being associated with at least two cross legs, the first cross leg having a support end and a pivot end, the pivot end pivotally connected to the bottom surface of the platform panel element and the second cross leg having a support end and a locking end, the locking end having a cross pin, the cross pin being engaged by the slot and groove assembly; the first cross leg and the second cross leg being connected together at a center joint;

pulling the support end of the cross leg having a locking end downward and outward away from the bottom surface of the platform panel element;

positioning the cross pin of the locking end of the cross leg within a groove of the slot and groove assembly; and moving the support ends of the cross legs toward the support plane.

18. The method of claim 17 wherein the variable height staging further comprises a telescoping arm for each pair of cross legs, the telescoping arm having two ends, each end of the telescoping arm connected proximate to the support end of each cross leg, the telescoping arm having a series of pin holes for insertion of a pin, the length of the telescoping arm being fixed when a pin is inserted in one of the pin holes.

19. The method of claim 17 further comprising the step of removing the pin from a pin hole so that the length of the telescoping arm can change prior to pulling the support ends of the cross legs downward and outward away from the bottom surface of the platform panel element.

20. The method of claim 19 further comprising the step of replacing the pin in one of the pin holes of the telescoping arm to fix the length of the telescoping arm before moving the support ends of the cross legs toward the support plane.

21. The method of claim 17 wherein the slot and groove assembly has at least four grooves for assembling the staging to at least four different heights.

* * * * *

UNITED STATES PATENT AND TRADEMARK OFFICE

CERTIFICATE OF CORRECTION

PATENT NO. : 6,014,936

DATED : January 18, 2000

INVENTOR(S) : Orley D. Rogers, et. al.

It is certified that error appears in the above-identified patent and that said Letters Patent is hereby corrected as shown below:

Title page, the following related U.S. application data should be added:

Related U.S. Application Data to Provisional application No. 60/054,271, filed on July 30, 1997.--

Signed and Sealed this

Twenty-fourth Day of October, 2000

*Attest:*

Q. TODD DICKINSON

*Attesting Officer*

*Director of Patents and Trademarks*